United States Patent [19]

Zundel

[11] 3,964,633

[45] June 22, 1976

[54] FULL OPEN END

[75] Inventor: Arthur P. Zundel, Cary, Ill.

[73] Assignee: National Can Corporation, Chicago, Ill.

[22] Filed: Dec. 12, 1974

[21] Appl. No.: 531,861

Related U.S. Application Data

[60] Division of Ser. No. 325,361, Jan. 22, 1973, Pat. No. 3,875,884, and a continuation-in-part of Ser. No. 195,095, Nov. 3, 1971, Pat. No. 3,712,503.

[52] U.S. Cl. ..... 220/273

[51] Int. Cl.[2] ..... B65D 41/32

[58] Field of Search ..... 220/270, 271, 272, 273

[56] References Cited

UNITED STATES PATENTS

| | | | |
|---|---|---|---|
| 3,601,279 | 8/1971 | O'Neill | 220/270 |
| 3,698,590 | 10/1972 | Cookson | 220/270 |
| 3,712,503 | 7/1975 | Zundel | 220/273 |

*Primary Examiner*—George T. Hall

*Attorney, Agent, or Firm*—James E. Anderson

[57] ABSTRACT

The present invention relates to a easy open end of the type that has a tab connection thereto by an integral rivet. The invention resides in an improved method for forming a weakened area or frangible connection between the permanent section of the panel and the removable section. The frangible connection in the panel is formed in such a manner that the removable section is relieved of any compressive forces that may have developed during the formation of the frangible connection. In addition, the removable section of the panel incorporates a further area of reduced cross-section that allows the tab and rivet to be pivoted relative to the removable panel section during initiation of rupture of the frangible connection and provides a vent for the inside of the container prior to the rupture of the fangible connection.

12 Claims, 12 Drawing Figures

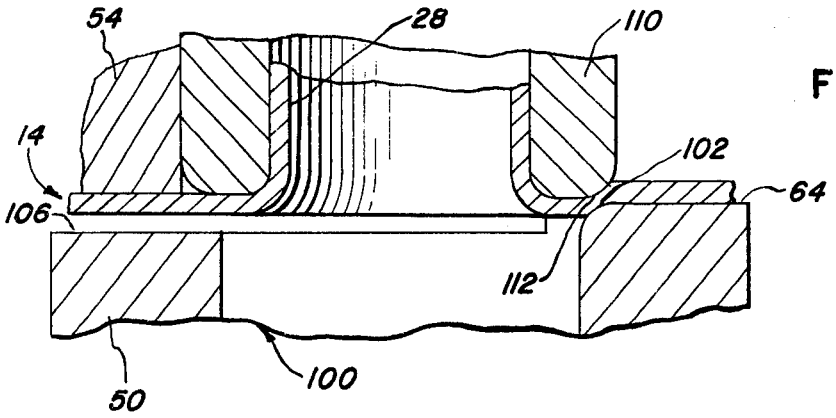
FIG. 10
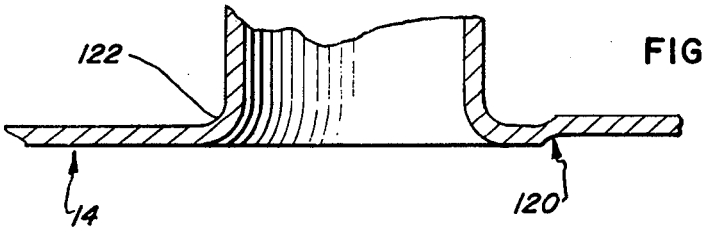
FIG. 11
FIG. 12
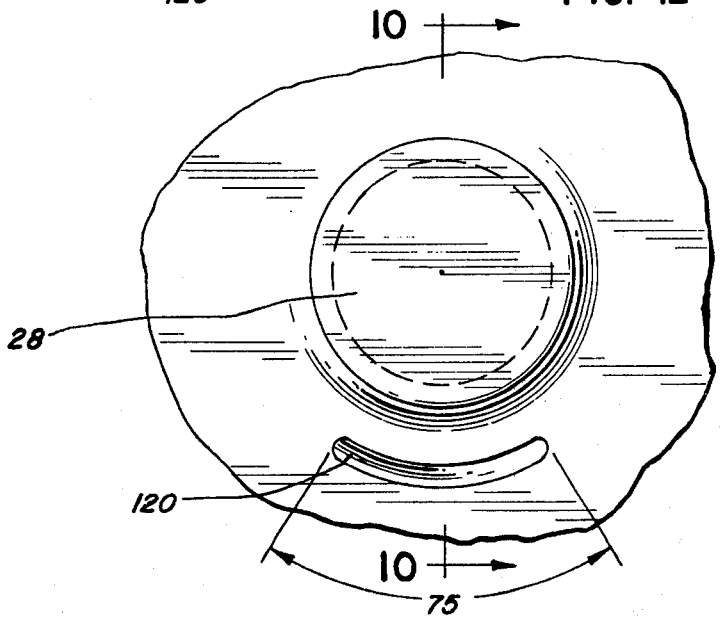
FIG. 7
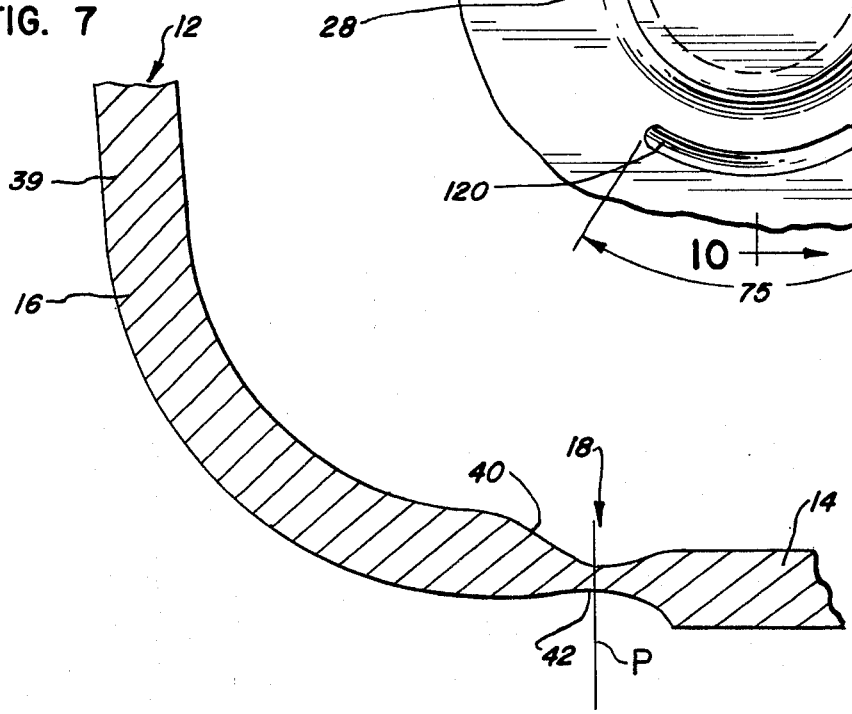

FULL OPEN END

REFERENCE TO RELATED APPLICATION

This is a division of application Ser. No. 325,361, filed Jan. 22, 1973, now U.S. Pat. No. 3,875,884.

This application is a continuation-in-part of application Ser. No. 195,095, filed Nov. 3, 1971 now U.S. Pat. No. 3,712,503.

BACKGROUND OF THE INVENTION

The present invention relates generally to container ends and more particularly to an improved fully open end.

Containers having easy open ends have become well-known in recent years and now enjoy a considerable measure of consumer acceptability. One type of easy open end is a full open end closure that normally includes an end panel that is permanently secured to one end of a container body by a permanent seam and has a weakened score line adjacent the permanent connection to define a removable section. An opening tab is secured to a portion of the removable section, normally through an integral rivet forming part of the removable section. Containers having full open ends are used for packaging various types of products, such as coffee, nuts, candy and foods containing liquid.

To separate the removable section from the permanently secured section, the opening tab is moved along a path by initially pivoting the tab towards the permanent seam to cause a downward movement of the portion of the removal section between the rivet and the score line to produce initiate rupture of the score line or weakened area. Subsequently, the tab is pulled in an opposite direction along a path away from the initially ruptured section until the entire score line has been ruptured and the removable section is detached from the permanent section.

As is explained in the above application, one difficulty encountered in full open end closures is that the severed edge of the removable section tends to become located under the adjacent edge of the permanently secured section during initial rupture of a portion of the weakened area of the score line, making it extremely difficult, if not impossible, to remove the entire closure.

In the co-pending application, it is explained that this is believed to be in part caused by loose metal in the removable section resulting from the scoring operation which forms the score line or weakened area that defines the removable portion of the end. This problem has been at least partially solved by providing a trough adjacent the rivet as well as a circumscribing bead located adjacent the weakened area to take up excess metal that is produced in the removable section during the formation of the finished end shown in the above application. As explained therein, the trough and circumferential bead also provides the advantage of preventing crowning between opposite edges of the removable section while it is being separated from the permanent section.

A further problem is that the normal scoring operation results in considerable stress concentration in the metal in the score line or frangible connection and often produces a small crack in the weakened area which thereby may result in fracture of the weakened area before it is desired.

In the normal scoring operation, the score line is produced by supporting one surface of the panel on a flat support and forcing a truncated V-shaped scoring member into the opposite surface of the panel. During the scoring operation, the metal that is located below the flat portion of the truncated V-shaped scoring member is displaced substantially normal to the panel and results in the large stress concentration in the weakened area of the score line. It has been found that such a scoring operation normally results in at least a small crack adjacent either corner or edge of the reduced cross-section or weakened area which will enhance the possibility of fracture of the weakened area before desired. Stated another way, the portion of the metal directly below the flat surface of the scoring element will act as a slug that initially consists of a section of metal in the panel that has a thickness equal to the thickness of the panel and is reduced in thickness to that of the ultimate thickness of the weakened area.

The problem of producing a small crack or fracture in the weakened area of the removable end is particularly acute when utilizing a metal such as tin plate for the end. Normally, such metals must be surface coated on both surfaces of the panel to prevent the bare metal from being exposed to either the contents of the container or the surrounding atmosphere. When utilizing a scoring operation of the type described above, one or both surface coatings may be cracked or fractured during the scoring operation.

Another problem in the use of full open end closures has come to light when using containers with these types of closures for packaging certain products that are packaged at conditions other than atmospheric pressure. It has been found that when certain products, such as coffee, are packaged in containers of the type discussed above, the initial rupture of the score line will result in an immediate equalization of the pressure between the inside and outside of the container, which many times results in the product being forced from the container through the initially ruptured area of the score line.

SUMMARY OF THE INVENTION

The present invention contemplates the formation of a fully easy open end closure that is capable of being removed smoothly and with a minimum amount of force. The weakened area defining the removable section is produced in a manner to minimize the concentration of stresses in the frangible portion of the panel. The end closure is deformed so that there is no excess metal in the removable section which may result in the adjacent edges of the removable section and the permanently secured section from being placed in overlapping relation. Also, the removable section of the end closure has a specifically located area of reduced cross-section or weakened area strategically located to act as a hinge in the panel allowing the tab that is connected thereto to be pivoted sufficiently to initiate rupture of the weakened area. The area of reduced cross-section may also be weakened sufficiently to initially fracture before the main weakened area to produce a vent to equalize the pressure between the inside and outside of the container before the weakened area defining the removable section is ruptured.

According to the broadest aspect of the present invention, the weakened area dividing the panel into a permanent section and a removable section is produced by engaging opposed surfaces of the panel with die elements having arcuate surfaces that allow the metal to flow from the weakened area that is being produced into the remainder of the panel to minimize the stress concentration in the weakened area or frangible connection of the panel. The panel is then expanded in a direction generally parallel to the plane of the removable section to remove any compressive forces resulting from excess metal that is developed in the removable section of the panel during the formation of the weakened area.

More specifically, the method of the present invention forms a weakened area between a flange portion or rim and a base portion of a cup shaped panel. Initially the flange portion defines an acute angle with respect to a plane extending normal to the base portion of the panel and the step of expanding the panel is performed by engaging the flange portion adjacent the base thereof to reduce the size of the acute angle. This is accomplished by initially supporting the panel on a female die element that has a first opening defining a first diameter and engaging the opposite surface of the panel with a first male die element that has a second diameter less than the first diameter and subsequently, expanding the panel by engaging the other surface of the panel with the second male die element that has a diameter greater than the second diameter and less than the first diameter while supporting the panel on the female die element.

The end panel that is produced by the method described above, consists of an integral removable section that is defined by a weakened area of material formed in the panel which joins the removable section to an adjacent or permanent section of the panel and the weakened area has opposed concave surfaces which produce an area of constantly reducing cross-section from opposite edges towards the center of the weakened area. In addition, the radii of curvature of the opposed concave surfaces are substantially greater than the thickness of the panel and the weakened area has a dimension between the opposite edges that is greater than the thickness of the panel.

According to another aspect of the invention, the removable section of the panel has a substantially continuous circumferential bead in close proximity to the weakened area and the bead has pairs of interrupted portions at opposed locations that define bend lines during the severing of the weakened area to separate the removable section from the adjacent or permanent section. The bead portions or indentations also assist in taking up excess metal that may be developed during the deformation of the panel.

According to a further aspect of the invention, the removable section of the panel is connected to an opening tab or member by an integral circular rivet that is deformed from the main body of the removable section adjacent the weakened area and the removable section has an area of reduced cross-section adjacent the circular rivet on the side opposite the weakened area and in close proximity to the circular connection or rivet. The weakened area of reduced cross-section has opposed arcuate concave surfaces and the linear dimension between opposite ends is substantially equal to the diameter of the circular connection or rivet. The area of reduced cross-section defines a circular arc that has a radius coincident with the center of the rivet.

The reduced area adjacent the rivet will develope sufficient excess metal in the panel to allow the tab to be pivoted relative to the panel and initiate rupture of the frangible connection.

The area of reduced cross-section may be weakened sufficiently to rupture before the frangible connection in the panel and allow the pressure to equalize inside and outside the container before the frangible connection is ruptured. The particular configuration and location of the area of reduced cross-section insures that this area is initially ruptured while still retaining sufficient integrity between the removable panel and the rivet to insure that the tab is not separated from the removable section.

BRIEF DESCRIPTION OF SEVERAL VIEWS OF DRAWINGS

FIG. 7 is an enlarged sectional view of the weakened area and the panel sections on opposite sides of the weakened area;

FIG. 10 is an enlarged fragmentary sectional view of the die elements and the panel as viewed along line 2—2 of FIG. 1 showing the formation of the rivet and area of the reduced cross-section adjacent the rivet;

FIG. 11 is a view similar to FIG. 10 showing the final configuration of the panel in the area of the rivet; and FIG. 12 is a fragmentary enlarged plan view of the panel showing the rivet and the adjacent area of reduced cross-section.

DETAILED DESCRIPTION

Figure 1:
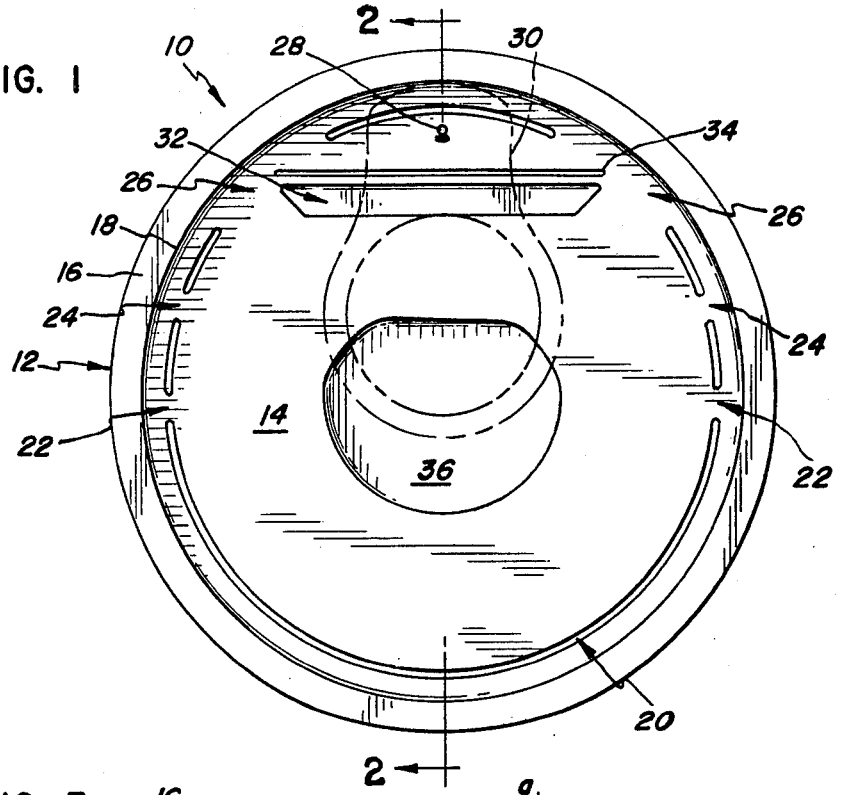
FIG. 1 is a plan view of an easy open end of the type shown in the above mentioned application.

While this invention is susceptible of embodiment in many different forms, there is shown in the drawings and will herein be described in detail one embodiment, with the understanding that the present disclosure is to be considered as an exemplification of the principles of the invention and is not intended to limit the invention to the embodiment illustrated.

Figure 2:
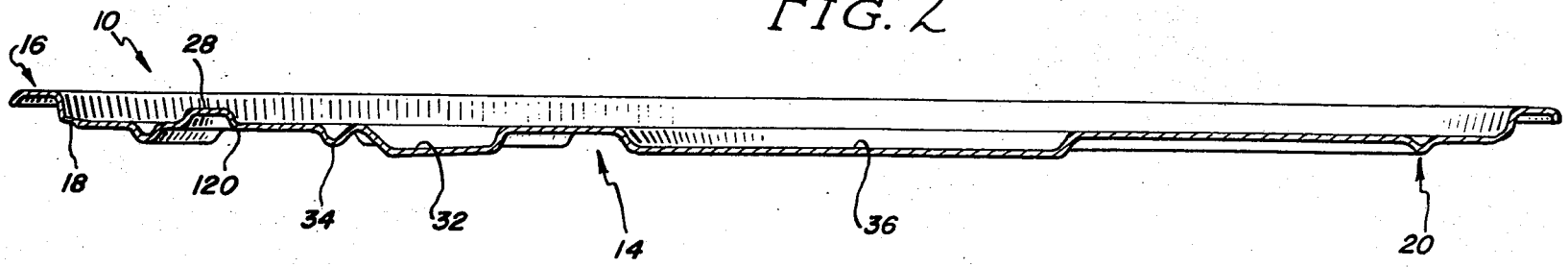
FIG. 2 is an enlarged section as viewed along line 2—2 of FIG. 1.

FIGS. 1 and 2 of the drawings generally show the container end 10 that is formed in accordance with the teachings of the present invention. The container end or fully open end 10 is generally shown and described in the above mentioned co-pending application and consists of panel 12 that is divided into a removable section 14 and a permanent or adjacent section 16 interconnected along a weakened area or frangible connection 18. The permanent section or rim 16 is adapted to be connected to the end of a container body by the usual double seam (not shown).

As explained in the above referenced application, the removable section 14 of the easy open end has a substantially continuous bead 20 that circumscribes the entire periphery of the removable section and is located in close proximity a substantially constant dimension from the weakened area 18. The bead 20 is interrupted at selected locations 22, 24 and 26 that define opposed pairs of interrupted portions to allow the removable section of the panel to be bent during the removal process.

The removable panel has an integral rivet 28 located adjacent one of the bead portions for connecting a tab thereto shown in phantom in FIG. 1. The removable section 14 of panel 12 also has a trough 32 located adjacent the rivet 28 and further bead 34 between the trough and the rivet. In addition, the removable section 14 has a downwardly dished portion 36 that is deformed from the planar main body portion of the removable section to provide a small space between the upper surface of the removable section and the lower surface of the opening tab 30.

As explained in the above mentioned application, the beads 20 and 34 as well as the trough 32 and the dished portion 36 take up excess metal that is developed during the formation of the weakened area 18 in panel 12. Furthermore, the beads and trough cooperate to act as means for preventing crowning or bulging of the removable section during the opening process and the interruptions 22, 24 and 26 in the substantially continuous bead 20 will accommodate bending of the removable section during the opening process.

As was indicated above, the normal scoring operation to produce a weakened area that defines a frangible connection between the removable section and the permanently attached section of the panel results in an extreme concentration of stresses in the frangible connection between the two sections. To reiterate, the use of either of a sharp cutting tool or a truncated V-shaped cutting tool to produce the weakened area results in a remendous concentration of stresses in the frangible connection or residual left between the panel sections which invariably results in small cracks developed in the frangible connection that weaken the connection.

According to the present invention, the frangible connection or weakened area between the two sections of the panel is produced in a manner that the material that must be displaced will flow into the main body of the panel without the compression of the material in a direction generally normal to the plane of the panel.

The configuration of the weakened area or frangible connection 18 is shown in enlarged detail in FIG. 7. As will be seen from an inspection of FIG. 7, the opposed surfaces of panel 12 are concave in the weakened area and are indicated by the reference numerals 40 and 42. The concave surfaces 40 and 42 have radii that are located on opposite sides of the panel. While not all points of the respective surfaces are not located at the same point, because of the expansion of the panel, when considering the radii of the surface segments, they may be considered to have a common center.

The radii of curvature of the respective concave surfaces 40 and 42 are greater than the thickness of the panel and the centers of the two concave surfaces 40 and 42 are located so that the width of the weakened area 18 is greater than the thickness of the panel and the center or residual of the weakened area or frangible connection has a thickness substantially less than the thickness of the panel.

Also, it will be noted that the area between the removable panel section 14 and the adjacent section 16 is of constantly reducing cross-section towards the center of the reduced cross-section.

According to another aspect of the invention, the weakened area 18 is produced in such a manner that the removable section is devoid of any excess metal that would result in compressive forces being developed which would cause the severed edge of the removable section to expand under the adjacent severed edge of the permanent section during initial rupture of the weakened area 18. The arcuate configuration of the opposed surfaces of the weakened area allows the metal to be displaced generally along the plane of the panel while the weakened area is being formed to substantially reduce the stressed concentration in the weakened area at that time. However, because a large amount of metal is displaced into the removable section of the panel, the excess metal develops compressive forces in the removable panel that will tend to cause the panel to expand when the weakened area is ruptured.

Figure 3:
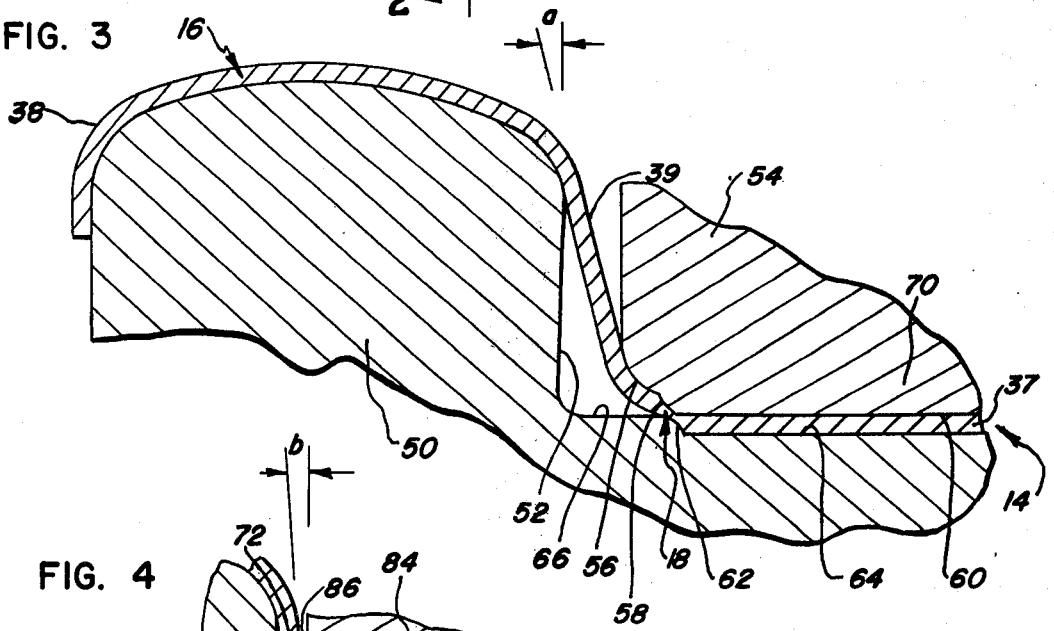
FIG. 3 is an enlarged fragmentary sectional view showing the die elements and the step of producing the weakened area.
Figure 4:
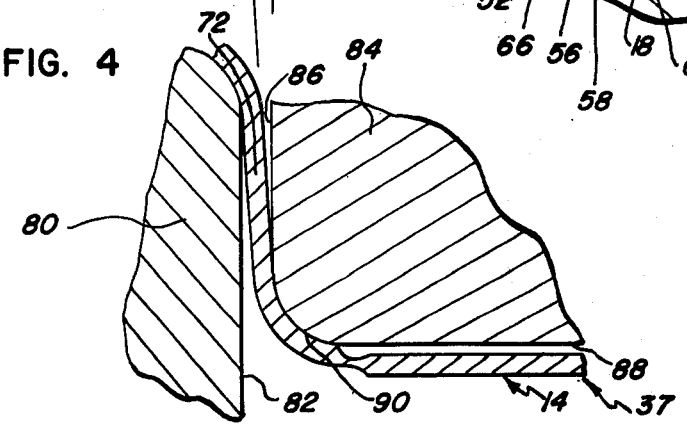
FIG. 4 is a view similar to FIG. 3 showing another step in forming the container end shown in FIG. 1.
Figure 5:
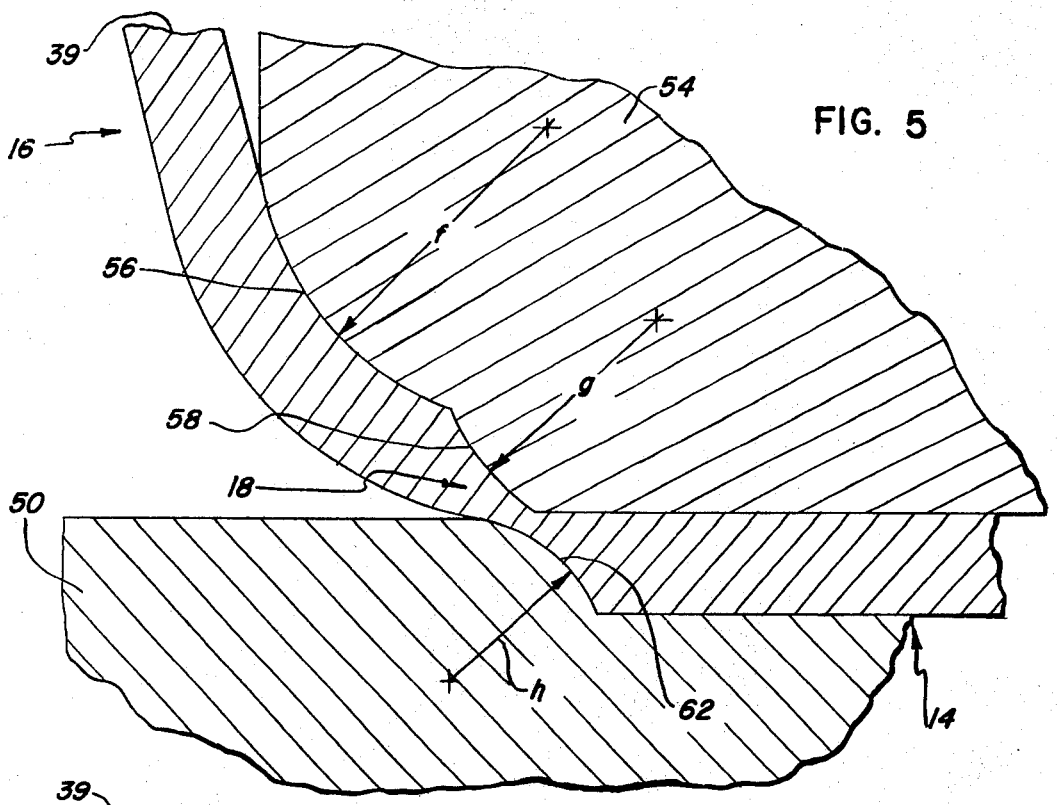
FIG. 5 is an enlarged fragmentary sectional view similar to FIG. 3.

The method of the present invention contemplates initially forming a weakened area in the metal panel circumscribing the removable section and thereafter, expanding the panel in a direction generally parallel to the plane of the removable section to remove any excess metal that would develop compressive forces in the removable section. The two steps of deforming a flat panel to the final configuration shown in cross-section in FIG. 7 are generally shown in FIGS. 3 and 4, while the details of the formation of the weakened area are shown in the enlarged views of FIGS. 5 and 6. Prior to the formation of the frangible connection, the panel 12 has been deformed to a cup shaped configuration having a base portion 37 and a rim 38 and the base portion has rivet 28 formed therein. The rim 38 has a flange portion 39 that merges with the base portion through an arcuate segment (a portion of which is shown in FIGS. 3 and 5). Flange portion 39 defines an acute angle *a* with respect to a plane extending normal to base portion 37.

Referring to FIG. 3, a cup shaped panel, such as tin plate having protective coatings on opposite surfaces thereof, is initially supported on a female die 50 that has an upwardly directed opening 52 which has an arcuate surface at the upper end thereof. The area of the female die element outside of the opening 52 is configured to conform to the peripheral edge of the rim, as shown in FIG. 3.

The opposite surface of panel 12 is engaged with a male die element 54 that has an outside diameter which is smaller that the diameter of opening 52 and the lower end of the side wall of the male die element 54 has a first arcuate surface 56 that merges with a second arcuate surface 58 which in turn merges with the flat bottom surface 60 of the male die element.

The female die element also has an arcuate surface 62 that is inwardly spaced from the opening and is generally aligned with arcuate surface 58. The area of the female die element 50 inside the arcuate surface 62 has a flat bottom wall 64 that is displaced downwardly with respect to the wall portion or ledge 66 between the wall of opening 52 and arcuate surface 62.

When the die elements are moved towards each other, the cup shaped panel will be deformed in the area the base portion 37 and rim 38 to produce weakened area 18. During this relative movement, the specific location of the centers of the two surfaces 58 and 62, and the fact that the surfaces engage the panel in the arcuate connections between base portion 37 and flange 39, will allow the metal to flow along the arcuate surfaces 58 and 62 rather than be compressed and produce the undesirable stress concentration in weakened area 18. At the same time the removable section 14 will be displaced downwardly relative to the rim or permanent section of panel 12. In the specific embodiment illustrated, the removable section is displaced by a dimension substantially equal to the thickness of the panel.

During the formation of the weakened area or frangible connection 18, it is desirable to have the rim 38 remain in a static condition. This is accomplished by making the radius of curvature of arcuate surface 56 equal to the radius of curvature of the arcuate connection between flange 39 and base portion 37. This will cause all of the metal that must be displaced from the weakened area to flow into the removable portion 14 of panel 12.

To eliminate the undesirable results of having excess metal in the removable section 14, the portion of the panel outwardly of the flange 39 is supported on a second female die element 80 having an opening 82 that is the same diameter as the opening 52 in the first female die element 50. However, opening 82 has sufficient depth so that the removable section remains unsupported and the upper end of die element 80 has a configuration similar to die element 50.

The opposite surface of panel 12 is then engaged with male die element 84, shown in FIG. 4, that has an outer surface or side wall 86 which has a diameter greater than that of die element 54 but less than the diameter of opening 82. Also, die element 84 has its side wall 86 merging with a flat bottom surface 88 along an arcuate surface 90 that has a radius of curvature greater than that of surface 56.

Moving die elements 80 and 84 towards each other while rim or permanent section 16 is supported on die element 80 will cause the male die element 84 to engage the surface of flange portion 39 and expand the panel 12 along a plane extending generally through the body of the panel. During this expansion of panel 12, the size of the acute angle defined between flange portion 39 and a plane extending generally normal to the plane of the removable section 14 will be reduced and the removable section 14 will be displaced upwardly to the position shown in FIG. 4. This expansion will increase the size of the base portion or flat portion 37 of panel 12 and locate frangible connection 18 in the flat portion 37 while the outer edge of rim 39 remains in a static condition.

Figure 6:
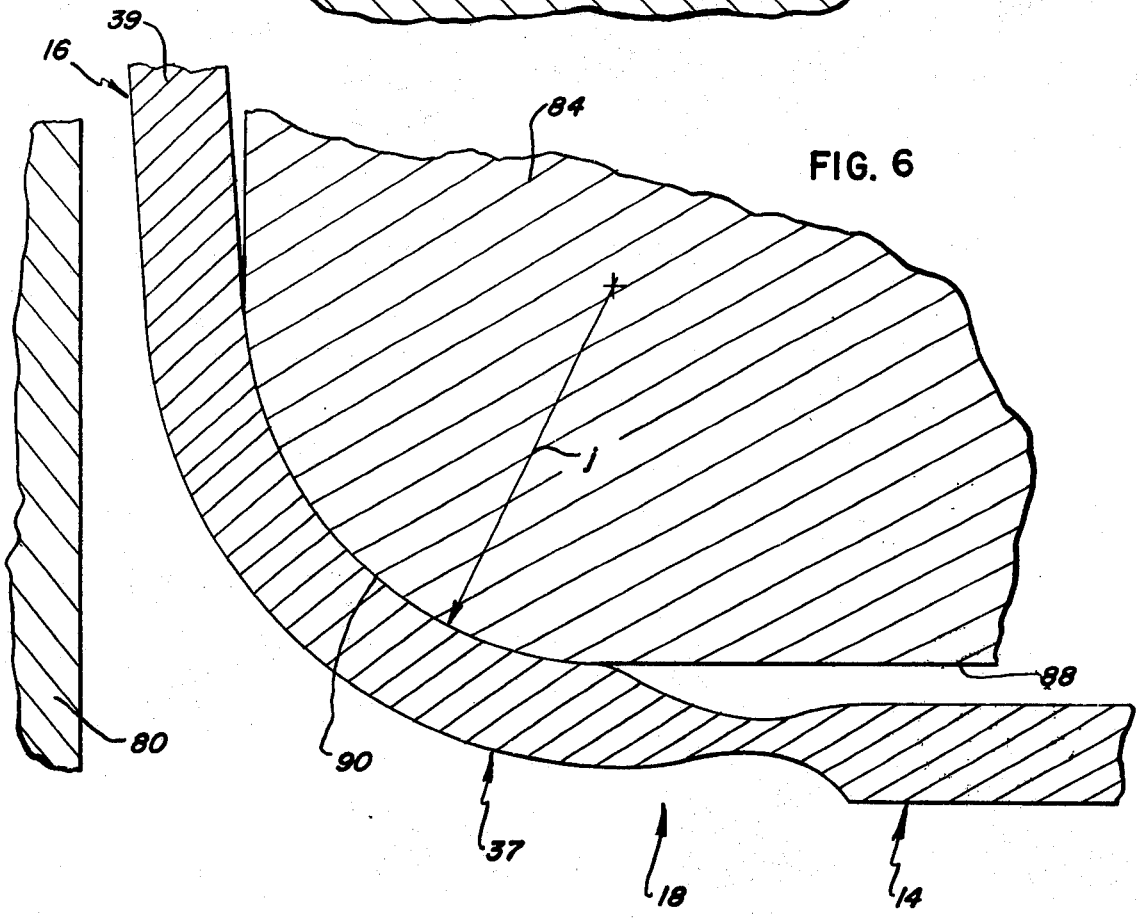
FIG. 6 is an enlarged fragmentary sectional view similar to FIG. 4, showing a relationship of the die elements and the panel adjacent the weakened area.

The advantages of the two step process of forming the weakened area will now be briefly summarized. During the first step, which may be called "cold swedging" all of the metal that is displaced from the weakened area flows into the removable section or base portion 14 of the panel and will result in excessive metal being located in the removable section which developes compressive forces that tend to expand the removable section. Thus, if the panel were to retain this configuration, during initial rupture of the score line, the compressive forces developed in the removable section would tend to expand the panel during the initial rupture of the weakened area or frangible connection and cause the severed edge of the removable section to be displaced under the adjacent severed edge of the permanent section 16. However, by subsequently expanding or sizing the area of the panel outside of the weakened area or frangible connection 18 that is shown in FIG. 6, will result in sufficient expansion of the removable section to remove any compressive forces developed in the removable section and, in fact, in most instances, place the removable section in tension. If the removable section is placed in tension, the severing of the weakened area or residual 18 will allow the removable section to assume the non-stressed condition and thereby contract which will result in having the severed edges of the weakened area move away from each other. This arrangement insures that there is no possibility of overlapping the adjacent severed edges that would prevent removal of the panel.

It should be noted that during the expansion of the panel, the removable section is displaced in a general direction normal to the plane of the removable section and in a direction opposite or towards the male die element. Also, since the panel is engaged outside the weakened area or frangible connection, this frangible connection is placed in what may be termed the flat portion of the panel, ie., inside the radius portion of the rim, as is clearly shown in FIGS. 6 and 7.

While the relative dimensions of the various radii and diameters are critical when considered with respect to each other, the specific dimensions that will now be described are for purposes of illustration only.

For example, deforming a metal panel having a thickness of 0.008 inches, the radius *f* in FIG. 5 would be on the order of 0.025 inches while the radius *g* would be on the order of 0.020 inches and the radius *h* of the female die element would be on the order of 0.014 inches. In addition, the radius *j* would be on the order of 0.032 inches.

With a panel initially deformed to a cup shaped configuration, wherein a flange 39 merges with the flat bottom wall or base portion 14 along a radius *f*, the panel would be deformed to produce the weakened area 18 located within the radius portion between the flange 39 and the base portion 14. At the same time, the base portion or removable section 14 would be displaced in a direction generally normal to the plane of the base portion 14 to the position shown generally in FIG. 5.

With the die elements as described, the minimum thickness of the weakened area will be about 0.0025 inches.

It has been found that the utilization of the die assemblies, as described above, will allow an accurate control of the displacement of the main section of the panel and produce the thickness of the smallest area of the residual in the weakened area to a point that has heretofore been not possible. For example, the removable section can be displaced to a point where the residual is on the order of 0.001 inches and still have a rigid connection between the removable section and the permanent section. This is believed to be a result of the particular configuration of the die elements which readily allows the metal that is being displaced to flow from the weakened area rather than be compressed and result in the stressed conditions heretofore known.

It should be noted that the final position of the removable section relative to the permanent section, i.e., the offset, will be determined by the diameter of male die element 84 and the radius of curvature of surface 90. It will be appreciated that the removable section will seek its own level since it is free to move.

While the removable section has been shown to be displaced downwardly in the "cold swedging" operation, in certain instances it may be desired to displace the removable section 14 upwardly during the formation of the frangible connection. By changing the figuration of the respective die elements, the removable section can be displaced upwardly by the same amount as is shown in FIG. 5, and then the panel could be expanded by engaging the radiused portion of the flange portion of the rim outwardly to expand or stretch the panel and result in the same final configuration of the panel that is shown in FIG. 6, except that the removable section would be displaced upwardly by the predetermined amount shown in FIG. 6. This arrangement would have the advantage of completely eliminating any possibility of overlap between the severed edges of the weakened area during the pulling phase of removal of the removable section.

It should be noted that when the end panel 10 is attached to the main body of the container by the double seam process, the panel, more particularly, the base portion thereof, will be further expanded to increase the tension of the metal in the removable section.

In the final configuration, a plane *p* extending through the minimum cross-sectional area or residual of the frangible connection 18 will define an angle of substantially 90° with respect to the plane that extends through the main body of panel portion 14. This further insures that the severed edge of the residual in the removable section will be able to move above the adjacent severed edge on the permanent section 16 during the rupture of the weakened area.

Figure 9:
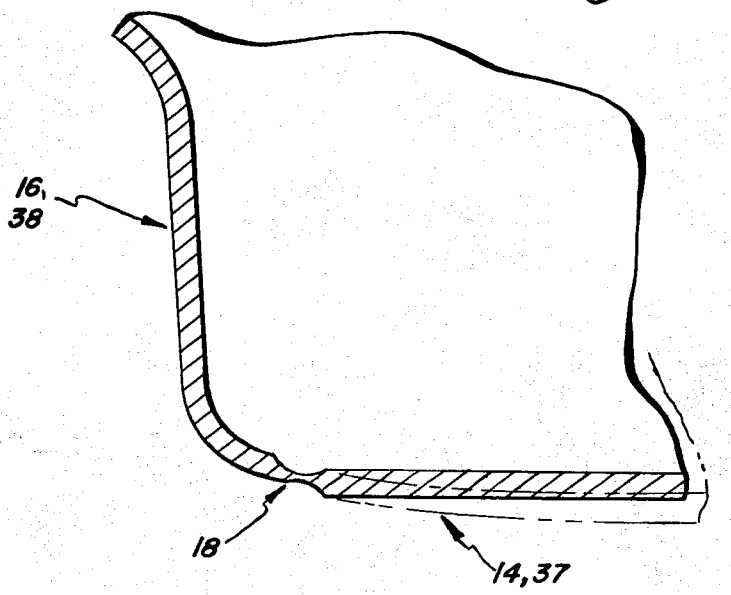
FIGS. 8 and 9 are views similar to FIGS. 3 and 4 respectively showing the panel in its initially deformed condition and finally deformed condition.
Figure 8:
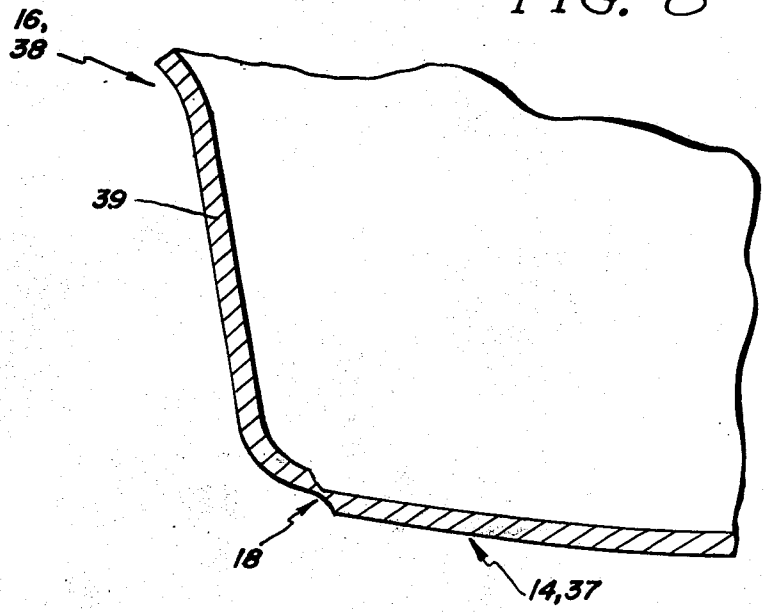

All of the excess metal in removable section can be removed in the sizing operation to eliminate any compressive forces in removable section 14 by proper selection of angles *a* and *b* in FIGS. 3 and 4, so that the removable section assumes the position shown in solid line in FIG. 9. However, in forming end 10, shown in FIG. 1, only a portion of the excess metal in removable section is removed during the sizing operation. For example, flange 39 initially defines an angle *a* of approximately 15° and the final angle *b* in FIG. 4 is approximately 4°. This will take up some excess metal in removable section 14 and change the dished configuration of removable section 14 from the position shown in FIG. 8 to the dotted line position of FIG. 9. The remainder of the excess metal will be removed during the profiling step that will now be described.

After the panel 12 has been reshaped as described above, further die elements are utilized to deform the removable section 14 and produce the portions of beads 20 and 34 as well as a trough 32 and the dished portion 36.

Beads 20 and trough 32 produce means for preventing crowning of the removable section of the panel between opposite points during the severing of frangible connection or weakened area 18. The formation of bead 20 and trough 32 as well as bead 34 and dished portion 36 will take up the remainder of the excess metal in the removable section during the deforming of the panel into final configuration shown in FIG. 2.

According to a further aspect of the present invention, a hinge is formed in the removable section of the panel for allowing the tab connected to the rivet to be pivoted and cause the nose portion of the tab to initiate the rupture of the weakened area between the rivet and the adjacent rim. It has been found that some type of hinge connection adjacent the rivet is necessary to allow the handle or lever to be pivoted during the initial rupture of the weakened area to produce the initial rupture in the frangible connection. It has been found to be advantageous to utilize a "cold swedging" technique similar to the "cold swedging" technique in producing the frangible connection 18 in an area adjacent the rivet but on a side opposite that of the weakened area. This will cause the metal to be displaced or flow into the panel adjacent the rivet and the excess metal will allow the lever or pull tab to be pivoted sufficiently during the first phase of removing the removable section and produce the initial rupture of the weakened area. A further advantage of the area of reduced cross-section adjacent the rivet is that reducing the residual left in the area of reduced cross-section will insure that the reduced area is severed during the initial pivotal movement of the lever so that this area acts as a vent to equalize the pressures between the inside of the container and the surrounding atmosphere before the weakened area 18 is initially ruptured. The details of this aspect of the invention are shown in FIGS. 10 to 12.

Before the "cold swedging" operation described above in connection with FIG. 5, the rivet 28 has previously been formed in the removable section of the panel through a multiple stage process that is well-known in the art. In order to produce the area of reduced cross-section or "smile" in a selected area surrounding the rivet 28, the wall defining an opening 100 in female die element 50 has an arcuate surface 102 that interconnects the wall of opening 100 with the upper surface 64 of die element 50, while the remainder of the upper surface of the die element has a cutout portion 106 in the area of rivet 28. The male die element 54 has an annular member 110 that has an inner diameter opening equal to the outer diameter of the rivet 28 with the portion of the annular member 110 that is opposed to arcuate surface 102 also having an arcuate surface 112.

Thus, during relative movement of the die elements 50 and 54, towards each other, the metal in the panel located between the opposed arcuate surfaces 102, 112 is "cold swedged" to produce an area of reduced cross-section 120 shown in FIG. 11. The metal that is displaced to produce the area of reduced cross-section flows into the adjacent portion of the removable section 14 to result in excess metal being located adjacent the reduced area cross-section. This excess metal will allow the rivet having the tab connected thereto to be pivoted with respect to removable section 14. The excess metal that is developed during the "cold swedging" operation to produce the area of reduced cross-section 120 will allow sufficient pivotal movement of the tab to produce the initial rupture of the weakened area or frangible connection 18 at a location adjacent the rivet.

If desired, the area of reduced cross-section can perform the additional function of providing a vent that will allow equalization of the pressures on opposite sides of removable section 14 before weakened area 18 is ruptured. This can be accomplished by reducing the residual in the area of reduced cross-section 120 to a point where the reduced area or residual 120 will be ruptured before the weakened area 18 is initially ruptured.

According to another aspect of the invention, the particular dimension of the area of reduced cross-section has been found to be critical. It has been found that if the area of reduced cross-section, in plan view as viewed in FIG. 12, is arcuate and defines an arc of less than 90° sufficient metal will be deformed in the area of reduced cross-section into the adjacent portion of the panel to allow the rivet to be pivoted relative to the panel sufficiently to produce the initial fracture of the weakened area and, if the area of reduced corss-section is made thin enough, this area will also rupture during this pivotal movement to provide pivot action.

As most clearly shown in FIG. 12, the area of reduced cross-section 120 circumscribes an arc of approximately 75° and the arc has its radius coincident with the center of rivet 28. Stated in another way, the linear dimension between opposite ends of the area of reduced cross-section is substantially equal to the diameter of the rivet 28.

In the above description, the die elements utilized for the "cold swedging" step and the sizing step were considered to be two separate sets of die elements. However, it will be appreciated that a single set of die elements having relatively movable parts could readily be used. For example, female die elements 50 and 80 could be one die element in which a portion having arcuate surface 62 could be lowered after the panel is deformed to the configuration of FIG. 5.

I claim:

1. An easy open container end, comprising a panel having a frangible connection of reduced cross-section dividing said panel into a removable section and a permanent section adapted to be connected to a container body, said frangible connection having two opposed concave surfaces producing an area of constantly reducing cross-section between said removable section and said permanent section, and a bead deformed from the panel in the removable section, said bead circumscribing substantially the entire periphery of said removable section and being located a substantially constant dimension from said frangible connection, said bead having pairs of interrupted portions to allow said section to be bent during removal.

2. An easy open container end as defined in claim 1, in which said removable section of said panel has a hollow connecting member deformed from the body adjacent said bead and said removable section has an area of reduced cross-section adjacent said connecting member on the side opposite said bead.

3. An easy open container end as defined in claim 2, in which said area of reduced cross-section has at least one concave surface.

4. An easy open container end as defined in claim 3, in which said area of reduced cross-section has two concave surfaces.

5. In an easy open panel having a removable section defined by a weakened area connecting the removable section to a permanent section, said removable section having a circular portion deformed from the main body of the panel adjacent the weakened area to define a permanent connection for a tab, said removable section having an area of reduced cross-section adjacent said circular portion on the side opposite said weakened area and in close proximity to the circular portion, said area of reduced cross-section being arcuate and having its center coincident with the center of said circular portion.

6. An easy open panel as defined in claim 5, in which said area of reduced cross-section circumscribes an arc of less than 90°.

7. An easy open panel as defined in claim 6, in which said area of reduced cross-section has at least one concave surface.

8. In an easy open container end, an integral removable section defined by a weakened area of material formed in a panel and joining said removable section to an adjacent section, said weakened area having opposed concave surfaces each having a radius of curvature greater than the thickness of said panel to produce a constantly reducing cross-section, said constantly reducing cross-section having its thinnest area located generally vertical with respect to said end so that application of a force generally vertical to said removable section will sever said thinnest area and allow the severed edge of the removable section to move above the severed edge of the adjacent section.

9. An easy open container end as defined in claim 8, in which a plane extending along one surface of said removable section is located intermediate opposed surfaces of said adjacent section.

10. An easy open container end as defined in claim 9, in which said thinnest area is located below said plane extending along said one surface.

11. An easy open container end as defined in claim 8, in which said thinnest area is located below a plane extending along the upper surface of said removable section.

12. In an easy open container end, an integral removable section defined by a weakened area of material formed in a panel and joining said removable section to an adjacent section of said panel, said weakened area being of constantly reducing cross-section between said sections with the thinnest portion located generally vertical with respect to said panel and below a plane along an upper surface and above a plane along a lower surface of said panel so that a vertical force to said removable section will sever the thinnest portion and locate said removable section above said adjacent section.

* * * * *